US005860827A

United States Patent [19]

Lee

[11] Patent Number: 5,860,827

[45] Date of Patent: Jan. 19, 1999

[54] PLUG SECURING DEVICE

[75] Inventor: Chin Chuan Lee, Shin-Chuang, Taiwan

[73] Assignee: Bochuh International Co., LTD., Taipei, Taiwan

[21] Appl. No.: 10,816

[22] Filed: Jan. 22, 1998

[51] Int. Cl.[6] ..... H01R 13/62

[52] U.S. Cl. ..... 439/373; 439/372

[58] Field of Search ..... 439/372, 373, 439/345, 358, 484

[56] References Cited

U.S. PATENT DOCUMENTS 2,266,560 12/1941 Mansfield ..... 439/373

5,593,313 1/1997 Shibuya et al. ..... 439/373

*Primary Examiner*—Khiem Nguyen

*Attorney, Agent, or Firm*—Pro-Techtor International Services

[57] ABSTRACT

A fastening device for a plug, which is plugged into a jack with two ends that each have a threaded hole, the fastening device comprising: a left bolt and a right bolt, each having a main body, a male thread, inserted in the threaded holes of the jack, and several transversal holes; and a securing wire, having two ends, two fastening sections at the two ends, which are inserted into a transversal hole of the left bolt and a transversal hole of the right bolt, two connecting sections, respectively continuing from the fastening sections, and a holding section between the two connecting sections; wherein the securing wire has a securing position for securing the plug on the jack and a releasing position for removing the plug from the jack and is switched between said securing and releasing positions by turning around the fastening sections.

6 Claims, 5 Drawing Sheets

PLUG SECURING DEVICE

BACKGROUND OF THE INVENTION

1. Field of the Invention

The present invention relates to a plug securing device, which is simple, durable, inexpensive and convenient to use.

2. Description of Related Art

When using electronic and data processing devices, a big worry is to lose power or data connections, which leads to loss of data and possibly to great damage. What is more, conventional power plugs and data connectors loosen easily.

To prevent plugs from falling off their jacks, screws that are fastened to the jacks or a casing have been used. The screws keep a plug fastened to its jack, but they are inconvenient to use. Whenever the plug is removed, the screws have to be loosened one by one. When the plug is put back, the screws have to be fastened one by one.

Therefore, recently another device for securing plugs has been designed, using fastening pins, which are inserted into suitable holes in the plug. Although this device works effectively and allows fast plugging and unplugging, it has a complicated structure. Considering the small space usually available and the mass use of securing devices, the probability of defects is relatively high. A plug with a defective securing device has to be replaced completely with the cable at a high cost, in order to achieve a securing capability again. Furthermore, the fastening pins of various samples often vary in position and size, which leads to inconvenient using.

SUMMARY OF THE INVENTION

An object of the present invention is to provide a plug securing device, which is simple and inexpensive.

Another object of the present invention is to provide a plug securing device, which allows for easy connecting and disconnecting of the plug and has a wide range of applications.

A further object of the present invention is to provide a plug securing device with a securing wire that is easy to replace.

The present invention can be more fully understood by reference to the following description and accompanying drawings.

DETAILED DESCRIPTION OF THE PREFERRED EMBODIMENTS

The plug securing device of the present invention serves to secure a plug 40 with a far end and an attached cable on a jack 30 with a left side and a right side. The plug securing device of the present invention comprises: a left bolt 1*a* and a right bolt 1*b*, respectively fastened to the left and right sides of the jack 30; and a securing wire 2, which is held by the left bolt 1*a* and the right bolt 1*b*. After connecting the plug 40 with the jack 30, the securing wire 2 is turned down into a securing position, where the plug 40 is blocked from falling off the jack 30. For removing the plug 40 from the jack 30, the securing wire 2 is turned up into a releasing position. The following explanation uses a power jack of a computer as an example.

Figure 1:
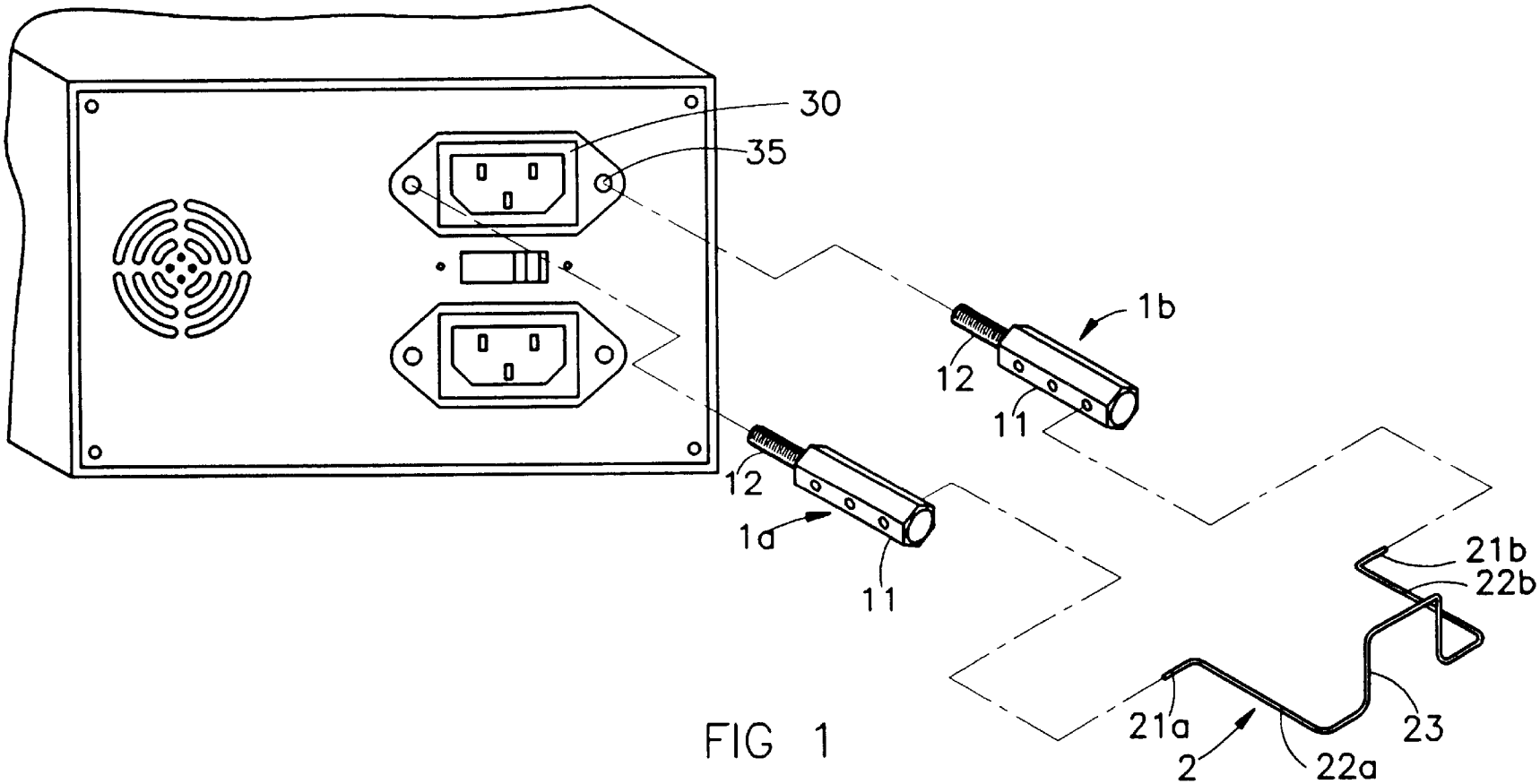
FIG. 1 is a perspective exploded view of the plug securing device of the present invention.

As shown in FIG. 1, the jack 30 has two threaded holes 35 on the left and right sides. The left bolt 1*a* and the right bolt 1*b* each have a main body 11 with a front end and a rear end. For each of the left and right bolts 1*a*, 1*b*, the main body 11 has a male thread 12 on the rear end and several transversal holes 13 (three shown in the Fig.), which are arranged parallel to each other in a row. There by the left and right bolts 1*a*, 1*b* are inserted into the threaded holes 35 in a way that each transversal hole 13 of the left hole 1*a* is aligned with a transversal hole 13 of the right bolt 1*b*.

Since each of the left and right bolts 1*a*, 1*b* has several transversal holes 13, various sizes of the plug 40 are adapted to.

The securing wire 2 has two ends and several sections: a left fastening section 21*a* and a right fastening section 21*b* at the ends, subsequently a left connecting section 22*a* and a right connecting section 22*b*, and a holding section 23 between the left and right connecting sections 22*a*, 22*b*. The left and right fastening sections 21*a*, 21*b* are inserted into two aligned transversal holes 13 of the left and right bolts 1*a*, 1*b*. The holding section is shaped like an inverted letter U that has further horizontal extensions.

The securing wire 2 is made of soft and elastic material and is a single wire, so as to reduce production costs.

Figure 2:
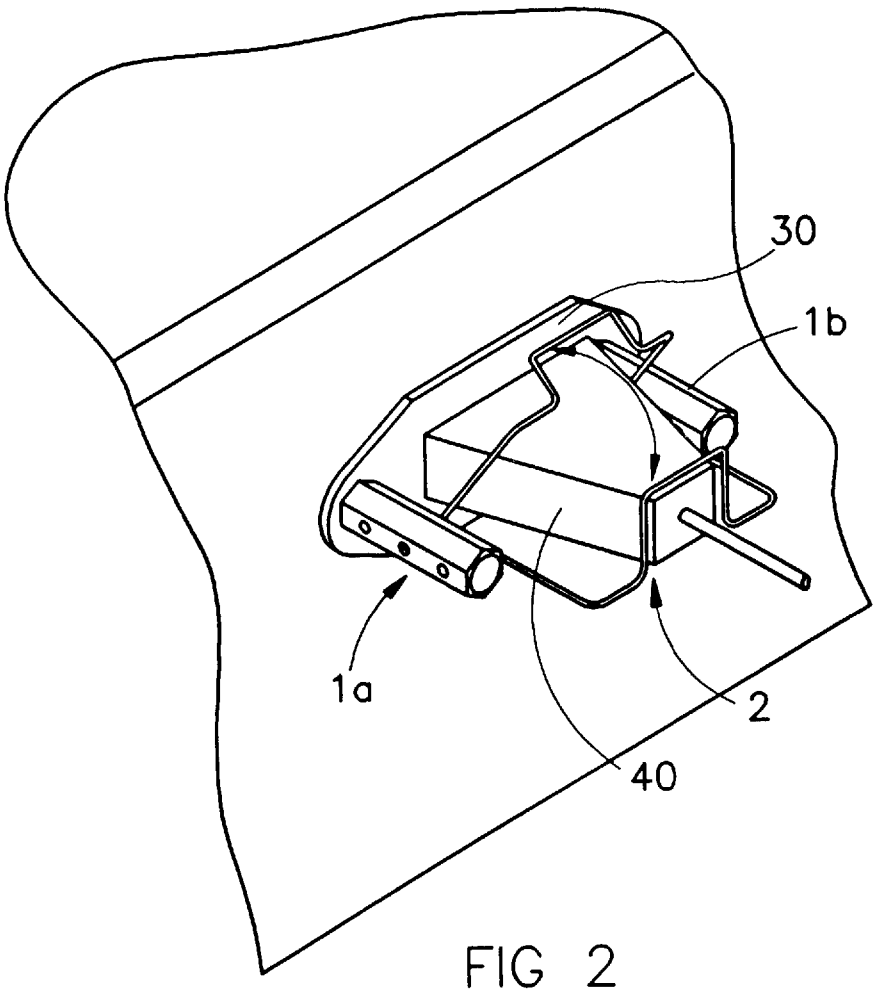
FIG. 2 is a schematic illustration of the present invention.

Referring to FIG. 2, after inserting the left and right fastening sections 21*a*, 21*b* into two aligned transversal holes 13, the left and right bolts 1*a*, 1*b* are secured against turning and will not loosen from the jack 30. The securing wire 2 is then switched between the securing and releasing positions by turning around the left and right fastening sections 21*a*, 21*b* as an axis, with the left and right connecting sections 22*a*, 22*b* as lever arms.

For each of the left and right bolts 1*a*, 1*b*, the main body 11 has a cylindrical or polygonal cross section, according to considerations of optical design. The front end of the main body 11 has a screw slit, a cross-shaped or a polygonal screw slot.

Figure 3:
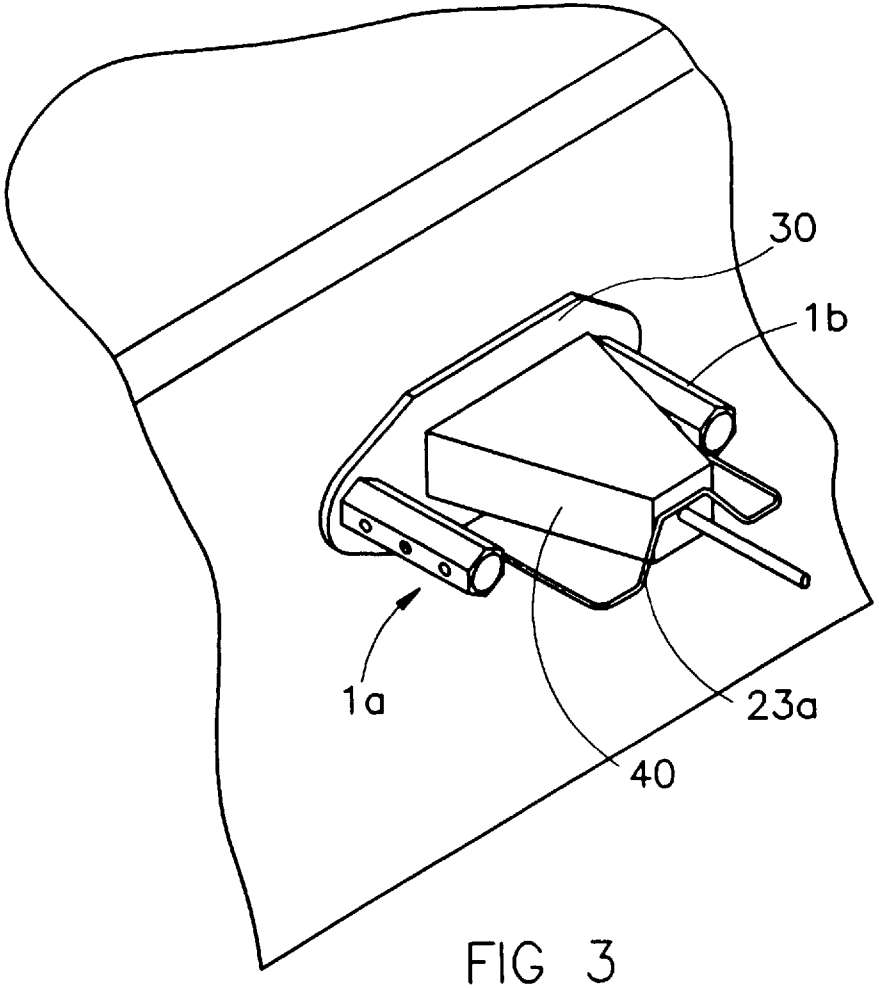
FIG. 3 is a schematical illustration of the present invention in another embodiment.
Figure 4:
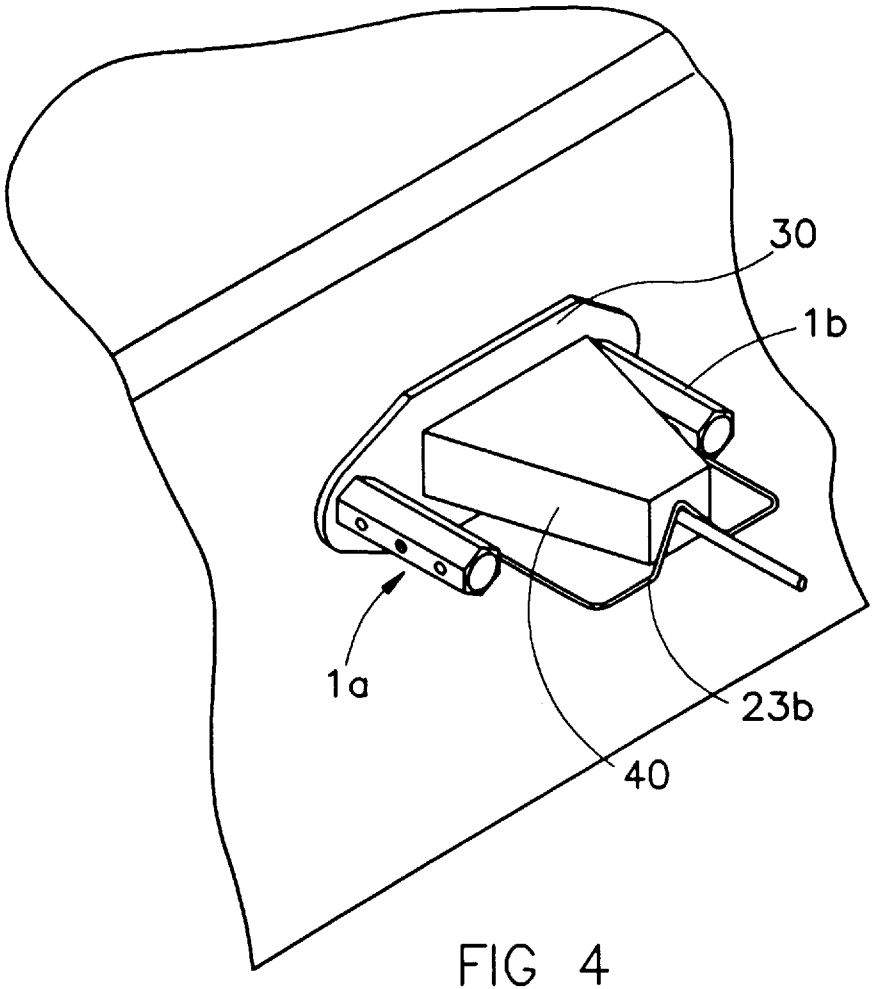
FIG. 4 is a schematical illustration of the present invention in a further embodiment.

The holding section 23 of the securing wire 2 holds the far end of the plug 40, as shown in FIG. 2. In another embodiment the present invention has a holding section 23*a*, which is shaped like an inverted letter V with further horizontal extensions. In the securing position, the holding section 23*a* rests on the cable, leaning against the far end of the plug 40, as shown in FIG. 3. In a further embodiment the present invention has a holding section 23*b*, which is shaped like an inverted letter V without further horizontal extensions. In the securing position, the holding section 23*b* rests on the cable, leaning against the far end of the plug 40, as shown in FIG. 4. Depending on the shape of the plug to be secured, the holding section of the securing wire 3 is implemented in other tapering shapes.

Figure 5:
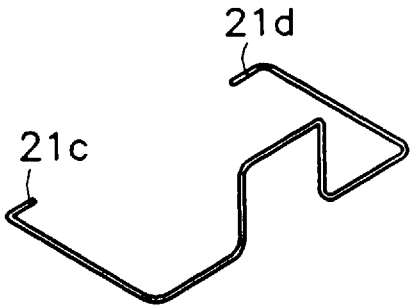
FIG. 5 is a schematical illustration of the securing wire of the present invention in another embodiment of the left and right fastening sections.

Referring to FIG. 5, the present invention in another embodiment has left and right fastening sections 21*c*, 21*d*, which point to each other and thus are inserted from outside into two aligning transversal holes 13 for easier installing of the securing wire.

Figure 7:
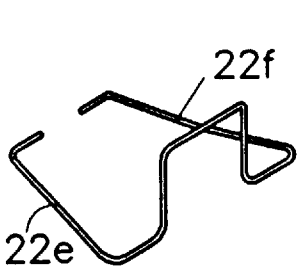
FIG. 7 is a schematical illustration of the securing wire of the present invention in a further embodiment of the left and right connecting sections.
Figure 6:
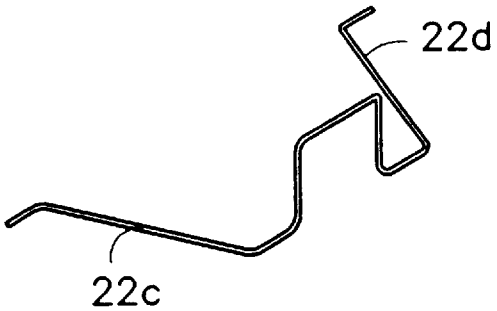
FIG. 6 is a schematical illustration of the securing wire of the present invention in another embodiment of the left and right connecting sections.

Referring to FIG. 6, the present invention in a further embodiment has left and right connecting sections 22*c*, 22*d* with a mutual distance that narrows towards the holding section. Referring to FIG. 7, the present invention in a further embodiment has left and right connecting sections 22*e*, 22*f* with a mutual distance that widens towards the holding section.

I claim:

1. A fastening device for a plug, which is plugged into a jack with two ends that each have a threaded hole, said fastening device comprising:

a left bolt and a right bolt, each having a main body, a male thread, inserted in said threaded holes of said jack, and several transversal holes; and a securing wire, having two ends, two fastening sections at said two ends, which are inserted into a transversal hole of said left bolt and a transversal hole of said right bolt, two connecting sections, respectively continuing from said fastening sections, and a holding section between said two connecting sections;

wherein said securing wire has a securing position for securing said plug on said jack and a releasing position for removing said plug from said jack and is switched between said securing and releasing positions by turning around said fastening sections.

2. A fastening device according to claim 1, wherein said transversal holes are through holes.

3. A fastening device according to claim 1, wherein each of said transversal holes of said left bolt is aligned with one of said transversal holes of said right bolt, forming a pair of holes and said two fastening sections are inserted into one of said pairs of holes.

4. A fastening device according to claim 1, wherein for said left and right bolts said main body has an accessible front end with a screw slit, a cross-shaped or a polygonal screw slot.

5. A fastening device according to claim 1, wherein said two connecting sections of said securing wire have a mutual distance that narrows or widens towards said holding section.

6. A fastening device according to claim 1, wherein said holding section is formed like an outline of a tapered two-dimensional shape.

* * * * *